US008517789B2

(12) United States Patent
Barber

(10) Patent No.: US 8,517,789 B2
(45) Date of Patent: Aug. 27, 2013

(54) LIGHTED TOY BRICK

(76) Inventor: Jason Barber, Portland, OR (US)

( * ) Notice: Subject to any disclaimer, the term of this patent is extended or adjusted under 35 U.S.C. 154(b) by 266 days.

(21) Appl. No.: 13/042,636

(22) Filed: Mar. 8, 2011

(65) Prior Publication Data

US 2011/0217898 A1 Sep. 8, 2011

Related U.S. Application Data

(60) Provisional application No. 61/311,521, filed on Mar. 8, 2010.

(51) Int. Cl.
*A63H 33/08* (2006.01)
*A63H 33/26* (2006.01)

(52) U.S. Cl.
USPC ..... 446/91; 446/128; 446/485

(58) Field of Classification Search
USPC ..... 446/91, 128, 485
See application file for complete search history.

(56) References Cited

U.S. PATENT DOCUMENTS

| | | | | |
|---|---|---|---|---|
| 3,237,341 | A | 3/1966 | Janning | |
| 3,484,984 | A | 12/1969 | Fischer | |
| 3,696,548 | A | 10/1972 | Teller | |
| 4,891,030 | A | 1/1990 | Gertzfeld | |
| 5,455,749 | A | 10/1995 | Ferber | |
| 5,733,167 | A | 3/1998 | Kroigaard | |
| 5,903,212 | A * | 5/1999 | Rodgers | 340/309.8 |
| 5,947,786 | A | 9/1999 | Glick | |
| 6,416,198 | B1 * | 7/2002 | Vanderschuit | 362/101 |
| 6,443,796 | B1 | 9/2002 | Shackelford | |
| 6,966,666 | B2 * | 11/2005 | Liu | 362/101 |
| 7,255,624 | B2 * | 8/2007 | Daftari | 446/92 |
| 7,322,873 | B2 | 1/2008 | Rosen et al. | |
| 7,731,558 | B2 | 6/2010 | Capriola | |
| 7,846,002 | B1 * | 12/2010 | Mikesell et al. | 446/91 |
| 2006/0134978 | A1 | 6/2006 | Rosen et al. | |
| 2007/0184722 | A1 | 8/2007 | Doherty | |
| 2009/0215357 | A1 | 8/2009 | Seligman | |
| 2009/0305602 | A1 | 12/2009 | Gaute | |

FOREIGN PATENT DOCUMENTS

| | | |
|---|---|---|
| DE | 3146247 | 11/1981 |
| GB | 2267041 | 11/1993 |
| JP | 2006-262939 | 10/2006 |
| JP | 2009-165593 | 7/2009 |

OTHER PUBLICATIONS

International Searching Authority; PCT International Search Report and Written Opinion mailed Nov. 25, 2011; entire document.

* cited by examiner

*Primary Examiner* — John Ricci
(74) *Attorney, Agent, or Firm* — Allen, Dyer, Doppelt, Milbrath & Gilchrist, P.A.

(57) ABSTRACT

A toy brick includes a housing adapted for releasable engagement to at least one other toy brick and having at least one translucent portion, at least one lighting device arranged inside the housing and adapted to generate light viewable through the at least one translucent portion, at least one battery arranged inside the housing and electrically connected to the at least one lighting device, and at least one switch arranged inside the housing and operable from outside the housing to illuminate the at least one lighting device. The at least one switch can be a motion-activated switch.

18 Claims, 2 Drawing Sheets

LIGHTED TOY BRICK

CROSS-REFERENCE TO RELATED APPLICATION

This application claims the benefit of U.S. Provisional Application Ser. No. 61/311,521, filed on Mar. 8, 2010, the contents of which are herein incorporated by reference in their entirety.

FIELD OF THE INVENTION

The present invention relates to toy bricks, and more particularly to toy bricks incorporating lighting devices.

BACKGROUND OF THE INVENTION

Toy brick sets have been well known for several years. Although there are many types of brick sets commercially available, they all generally involve individual bricks with complementary attachment surfaces allowing the bricks to be releasably connected to form a larger structure.

In the past, lighting and other electrical devices have been incorporated into toy bricks. An example of such bricks can be seen in U.S. Pat. No. 7,708,615 (the contents of which are herein incorporated by reference in their entirety). Typical of such bricks, control and power for the lighting or other electrical device are provided separately from the lighted brick, itself. While such bricks are useful, further improvements are possible.

SUMMARY OF THE INVENTION

In view of the foregoing, it is an object of the present invention to provide an improved lighted toy brick. According to an embodiment of the present invention, a toy brick includes a housing adapted for releasable engagement to at least one other toy brick and having at least one translucent portion, at least one lighting device arranged inside the housing and adapted to generate light viewable through the at least one translucent portion, at least one battery arranged inside the housing and electrically connected to the at least one lighting device, and at least one switch arranged inside the housing and operable from outside the housing to illuminate the at least one lighting device.

According to an aspect of the present invention, the housing is hermetically sealed. According to another aspect of the present invention, the at least one switch is motion-activated.

These and other objects, aspects and advantages of the present invention will be better appreciated in view of the drawings, and following description of preferred embodiments.

DETAILED DESCRIPTION OF PREFERRED EMBODIMENTS

Figure 1:
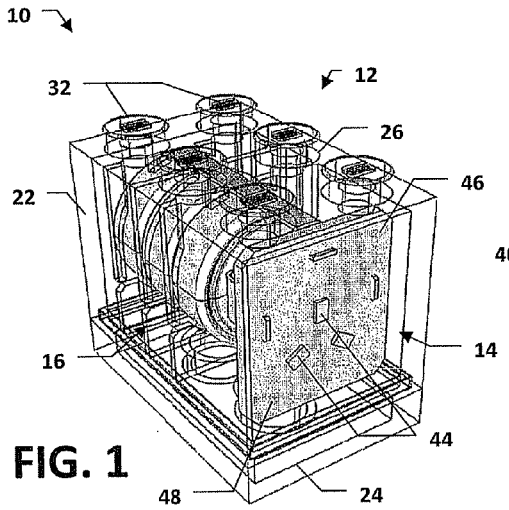
FIG. 1 is a perspective view of a toy brick, according to an embodiment of the present invention.
Figure 2:
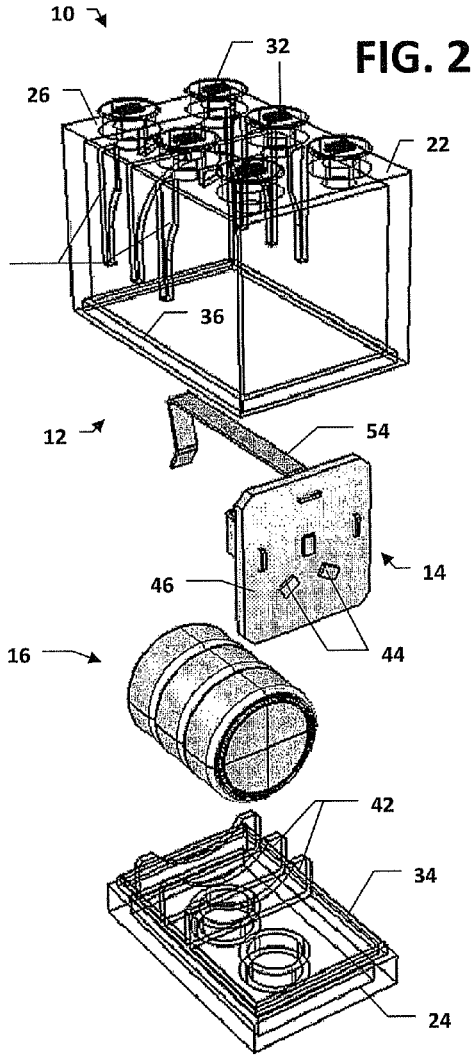
FIG. 2 is a partially exploded perspective view of the toy brick of FIG. 1.
Figure 3:
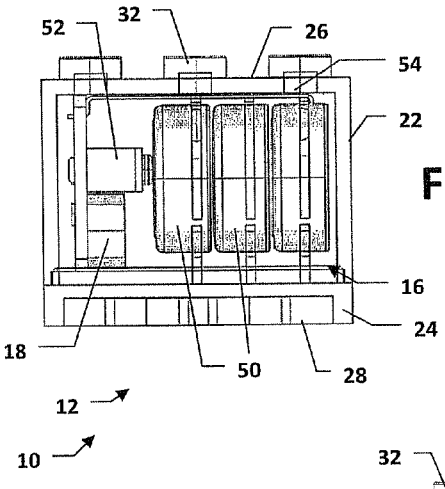
FIG. 3 is a side view of the toy brick of FIG. 1.
Figure 4:
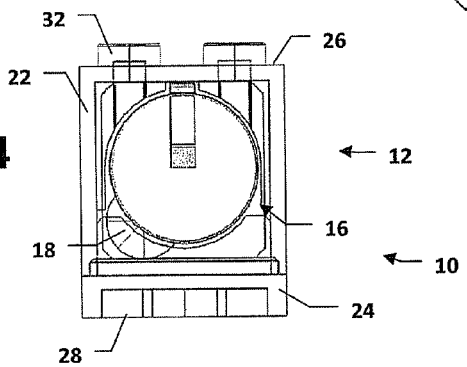
FIG. 4 is a end view of the toy brick of FIG. 1.

Referring to FIGS. 1-4, according to an embodiment of the present invention, a toy brick 10 includes a housing 12, at least one lighting device 14, at least one battery 16 and at least one switch 18. The housing 12 is advantageously hermetically sealed, with the at least one lighting device 14, battery 16 and switch 18 arranged therein; The housing 12 is adapted for releasable engagement to at least one other toy brick. The at least one lighting device 14, battery 16 and switch 18 are electrically connected, with the switch 18 operable from outside the housing 12 to illuminate the at least one lighting device 14.

The housing 12 is preferably made of a plastic material having at least one translucent portion. As used herein, "translucent" means translucent or transparent. Advantageously, the entire housing 12 can be substantially transparent. Additionally, the housing 12 can be substantially clear, or alternately, be tinted.

The housing 12 includes an upper portion 22 and a lower portion 24. The upper portion 22 has a first attachment surface 26 and the lower portion has a second attachment surface 28, each of which surfaces 26, 28 are configured for releasable engagement with complementary attachment surfaces of other toy bricks. Preferably, the first attachment surface 26 has a plurality of posts 32 configured for releasable engagement within recessed areas of other toy bricks, and the second attachment surface 28 has a recessed area configured for releasable engagement of posts of other toy bricks.

For air-and water-tightness, the upper portion 22 and lower portion 24 of the housing 12 are preferably hermetically sealed together. Advantageously, the upper and lower portions 22, 24 can be ultrasonically welded together. To facilitate connection/sealing, a lip 34 of the lower portion 24 is closely accommodated within an opening 36 of the upper portion 22.

Cradle sections 40 are formed on inner surfaces of the upper portion 22 with opposed cradle sections 42 formed on an inner surface of the lower portion 24. The cradle sections 40, 42 cooperate to support the at least one battery 16 therebetween.

The at least one lighting device 14 preferably includes a plurality of light emitting diodes 44. The plurality of light emitting diodes 44 can be commonly mounted on a printed circuit board 46. The plurality of light emitting diodes 44 can include light emitting diodes adapted to produce different colors.

The circuit board 46 is arranged proximate to a side 48 of the housing 12, with the light emitting diodes 44 on a surface of the circuit board 46 generally facing the side 48. Alternately, the light emitting diodes 44 could be mounted on an opposite surface of the circuit board 46 generally facing away from the side 48, or some light emitting diodes 44 could be mounted on both surface of the circuit board 46.

The at least one battery 16 preferably includes a plurality of button cell batteries 50. The plurality of batteries 50 can be connected in series, with first and second connectors 52, 54 extending between the circuit board 46 and opposite poles of the series-connected batteries 50.

The at least one switch 18 is advantageously a motion-activated switch, such that the switch 18 is activatable by motion imparted to the brick 10, such as shaking, bumping, knocking and the like. Preferably, upon an activation of the switch 18, the at least one lighting device 14 remains in operation for only a predetermined time. The predetermined time can be effected by the mechanical structure of the at least one switch 18 or by other electronic circuitry in the brick 10.

Figure 5:
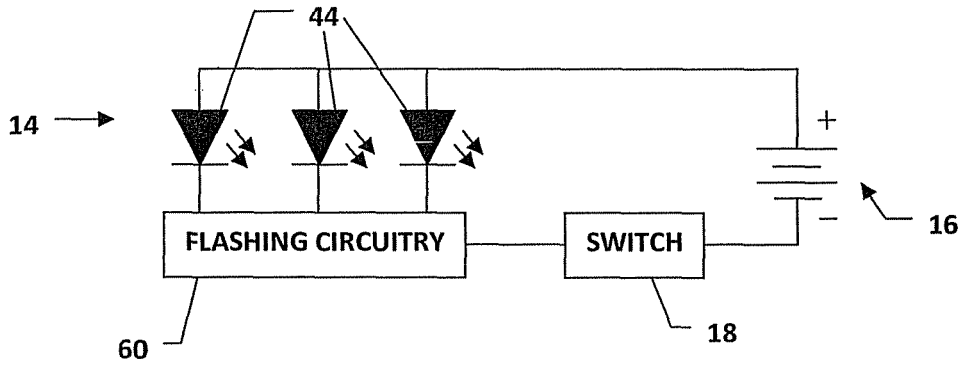
FIG. 5 is an electrical circuit schematic for the toy brick of FIG. 1.

Referring to FIG. 5, flashing circuitry 60 can be arranged in connection with the light emitting diodes 44, or other light sources, to allow flashing according to a predetermined pattern. For instance, each the light emitting diodes 44 flashes alternately, although other combinations are possible. The flashing circuitry 60 can include an integrated circuit, separate transistors, or other component combinations to achieve the desired effect. In the depicted embodiment, the switch 18 is directly in series with the at least one lighting device 14, battery 16 and flashing circuitry 60. However, other arrangements are possible.

Figure 6:
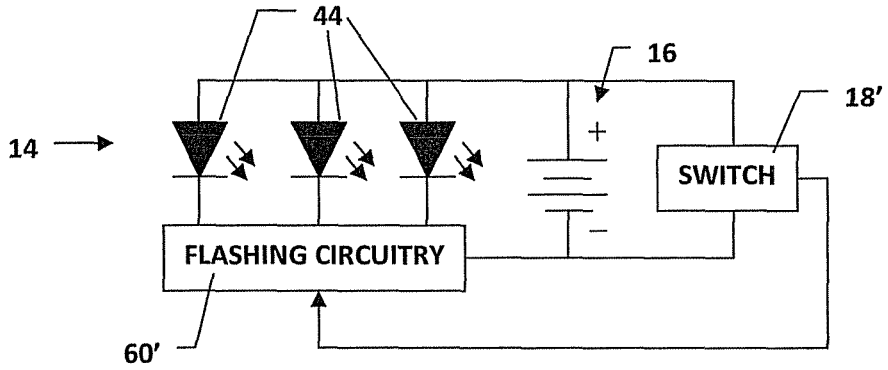
FIG. 6 is an alternate electrical circuit schematic for the toy brick of FIG. 1.

For instance, referring to FIG. 6, a switch 16' can be used to trigger flashing circuitry 60', which in turn solely controls the supply of current to the lighting device 14 and includes, as desired, the necessary timing circuit to de-activate the lighting device 14 after a predetermined time.

Other variations to the invention are also possible. The foregoing description is provided for exemplary and illustrative purposes. The present invention is not necessarily limited thereto.

For instance, the depicted brick 10 is a generally rectangular solid, with a 3×2 grid of posts 32. Other brick sizes and shape are possible within the scope of the present invention. For example, cylindrical brick shapes could be employed. Bricks with different numbers and configuration of posts could be used, as well as bricks with other types of attachment surfaces. Additionally, though light emitting diodes 44 are preferred, other light sources could be used for lighting devices. Likewise, other types of batteries are also employable.

The motion-activated switch is advantageous because it requires no penetrations through the hermetically-sealed housing to allow activation. The brick 10 is accordingly robust and unaffected by the intrusion of dirt or moisture into the electrical components. Safety is also enhanced. However, other types of switches can be employed, though most preferably switch-types that do not require any housing penetrations. Some non-limiting examples include: photo switches (e.g., to activate when dark), magnetically-activated switches and radio frequency (RF) activated switches.

The foregoing is not an exclusive list of possible variations. Rather, those skilled in the art will appreciate that these and other modifications, as well as adaptations for particular circumstances, will fall within the scope of the invention as herein shown and described, and of the claims appended hereto.

What is claimed is:

1. A toy brick comprising:

a housing adapted for releasable engagement to at least one other toy brick, the housing including at least one translucent portion;

at least one lighting device arranged inside the housing and adapted to generate light viewable through the at least one translucent portion;

at least one battery arranged inside the housing and electrically connected to the at least one lighting device; and at least one switch arranged inside the housing and operable from outside the housing to illuminate the at least one lighting device;

wherein the housing is hermetically sealed:

wherein the housing includes an upper portion and a lower portion, the upper portion being ultrasonically welded to the lower portion.

2. A toy brick comprising:

a housing adapted for releasable engagement to at least one other toy brick, the housing including at least one translucent portion:

at least one lighting device arranged inside the housing and adapted to generate light viewable through the at least one translucent portion;

at least one battery arranged inside the housing and electrically connected to the at least one lighting device; and at least one switch arranged inside the housing and operable from outside the housing to illuminate the at least one lighting device:

wherein the housing includes an attachment surface having a plurality of posts configured for releasable engagement by a recessed area of the at least one other toy brick.

3. A toy brick comprising:

a housing adapted for releasable engagement to at least one other toy brick, the housing including at least one translucent portion;

at least one lighting device arranged inside the housing and adapted to generate light viewable through the at least one translucent portion;

at least one battery arranged inside the housing and electrically connected to the at least one lighting device: and at least one switch arranged inside the housing and operable from outside the housing to illuminate the at least one lighting device;

wherein the housing includes an attachment surface having a recessed area configured to releasably engage a plurality of posts of the at least one other toy brick.

4. A toy brick comprising:

a housing adapted for releasable engagement to at least one other toy brick, the housing including at least one translucent portion;

at least one lighting device arranged inside the housing and adapted to generate light viewable through the at least one translucent portion;

at least one battery arranged inside the housing and electrically connected to the at least one lighting device; and at least one switch arranged inside the housing and operable from outside the housing to illuminate the at least one lighting device;

wherein the housing includes upper and lower portions, the upper and lower portions having respective attachment portions thereon configured for releasable engagement with the at least one other toy brick.

5. The toy brick of claim 4, wherein the housing is hermetically sealed.

6. The toy brick of claim 4, wherein the housing is substantially transparent.

7. The toy brick of claim 4, wherein the at least one lighting device includes at least one light emitting diode.

8. The toy brick of claim 7, wherein the at least one lighting device includes a plurality of light emitting diodes.

9. The toy brick of claim 8, wherein the plurality of light emitting diodes are configured to alternately flash.

10. The toy brick of claim 8, wherein the plurality of light emitting diodes are commonly mounted on a printed circuit board.

11. The toy brick of claim 4, wherein the at least one lighting device is electrically connected so as to flash.

12. The toy brick of claim 4, wherein the at least one battery includes a plurality of batteries.

13. The toy brick of claim 12, wherein the plurality of batteries are electrically connected in series.

14. The toy brick of claim 4, wherein the at least one switch is a motion-activated switch.

15. The toy brick of claim 4, wherein the at least one switch is configured to stop illuminating the at least one light after a predetermined time.

16. A toy brick comprising:

a substantially translucent, hermetically sealed housing having first and second attachment surfaces configured for releasable engagement with complementary attachment surfaces of other toy bricks;

at least one lighting device arranged inside the housing;

at least one battery electrically connected to the at least one light; and at least one motion-activated switch arranged inside the housing and operable to illuminate the at least one lighting device:

wherein the housing includes an upper portion having the first attachment surface and lower portion having the second attachment surface, the first attachment surface including a plurality of posts and the second attachment surface including a recessed area.

17. The toy brick of claim 16, wherein the at least one lighting device includes a plurality of light emitting diodes commonly mounted on a printed circuit board.

18. The toy brick of claim 17, wherein the at least one lighting device is electrically connected so as to alternately flash the plurality of light emitting diodes.

* * * * *